United States Patent [19]

Leppänen

[11] Patent Number: 4,728,219

[45] Date of Patent: Mar. 1, 1988

[54] METHOD OF AND A DEVICE FOR GUIDING A WIRE IN THE WIRE BOLTING OF A ROCK

[75] Inventor: Jarmo Leppänen, Ylöjärvi, Finland

[73] Assignee: Oy Tampella Ab, Tampere, Finland

[21] Appl. No.: 921,155

[22] Filed: Oct. 21, 1986

[30] Foreign Application Priority Data

Nov. 7, 1985 [FI] Finland ..... 854375

[51] Int. Cl.[4] ..... E21D 20/02

[52] U.S. Cl. ..... 405/260; 242/54 R; 242/129; 405/261

[58] Field of Search ..... 405/259, 260, 261, 262, 405/303; 242/54 R, 129, 128

[56] References Cited

U.S. PATENT DOCUMENTS

| | | | |
|---|---|---|---|
| 1,969,324 | 8/1934 | Poulter | 366/325 X |
| 1,982,610 | 11/1934 | Harris | 137/355 |
| 2,055,885 | 9/1936 | Weston | 264/31 |
| 2,176,891 | 10/1939 | Crom | 264/31 |
| 2,274,883 | 3/1942 | Brach | 52/110 |
| 2,286,904 | 6/1942 | Ewald | 137/355.26 |
| 2,544,119 | 3/1951 | Wolfe | 138/138 |
| 2,692,092 | 10/1954 | Kinginger | 242/86.5 R |
| 2,985,404 | 5/1961 | Tashiro | 242/128 |
| 3,225,974 | 12/1965 | Athas | 222/529 |
| 3,273,813 | 9/1966 | George | 242/54 A |
| 3,379,019 | 4/1968 | Williams . | |
| 3,436,923 | 4/1969 | Lagerstrom . | |
| 3,520,725 | 7/1970 | Hamrick | 134/21 |
| 3,593,943 | 7/1971 | Collmann | 242/129 |
| 3,608,710 | 9/1971 | Pugh | 405/154 |
| 3,744,734 | 7/1973 | Lodato et al. | 242/129 |
| 3,809,333 | 5/1974 | Lefever | 242/129 |
| 3,815,845 | 6/1974 | Rygiol | 242/129 |
| 3,949,778 | 4/1976 | Woodford et al. | 137/355.16 |
| 4,066,093 | 1/1978 | Egerstrom | 137/355.2 |
| 4,079,592 | 3/1978 | Eakin | 405/260 |
| 4,085,492 | 4/1978 | Stange | 405/259 X |
| 4,116,368 | 9/1978 | Smith | 222/145 |
| 4,151,965 | 5/1979 | Manabe | 242/54 R |
| 4,253,813 | 3/1981 | Farrell, Jr. | 425/90 |
| 4,289,427 | 9/1981 | Rolston | 405/260 |
| 4,305,553 | 12/1981 | Coquerel | 242/86 |
| 4,344,553 | 8/1982 | Lesher et al. | 226/168 |
| 4,453,679 | 6/1984 | Thuries et al. | 242/54 A |
| 4,514,111 | 4/1985 | Issakainen . | |
| 4,589,803 | 5/1986 | Totten | 405/259 |
| 4,601,518 | 7/1986 | Lanéus . | |
| 4,615,234 | 10/1986 | Chevance et al. | 74/501 R |
| 4,617,715 | 10/1986 | Koistinen et al. . | |
| 4,624,400 | 11/1986 | Zimmer | 226/188 |
| 4,643,619 | 2/1987 | Issakainen | 405/303 |

FOREIGN PATENT DOCUMENTS

| | | | |
|---|---|---|---|
| 822622 | 9/1982 | Finland | 405/260 |
| 831481 | 10/1984 | Finland | 405/260 |
| 1460292 | 10/1966 | France . | |
| 1367404 | 9/1974 | United Kingdom . | |

*Primary Examiner*—Dennis L. Taylor

*Attorney, Agent, or Firm*—Birch, Stewart, Kolasch & Birch

[57] ABSTRACT

A method of and a device for guiding a wire in the wire bolting of a rock, wherein the wire is passed by means of a feeding mechanism from a wire magazine into a guide head supported by a feeding beam of the drilling equipment therethrough into a hole drilled in the rock. In order to protect the feeding mechanism against damage and dirt and in order to lighten the feeding beam, the wire is pushed into the guide head through a flexible guide pipe in such a manner that the feeding mechanism can be mounted on a carrier.

9 Claims, 1 Drawing Figure

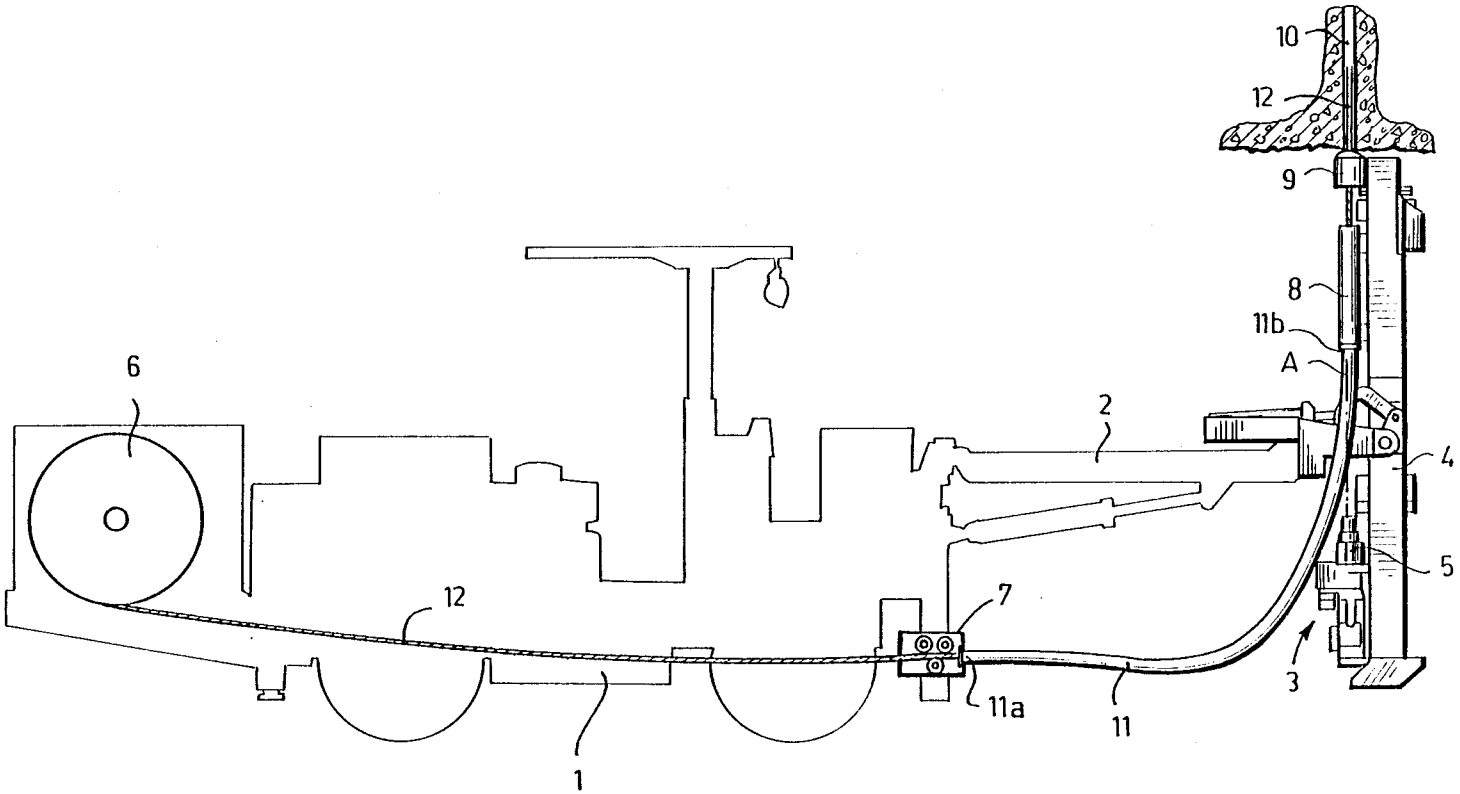
10
12
9
8
11b
A
4
5
3
2
7
11a
11
1
12
6

METHOD OF AND A DEVICE FOR GUIDING A WIRE IN THE WIRE BOLTING OF A ROCK

This invention relates to a method of guiding a wire in the wire bolting of a rock, wherein the wire is passed by means of a feeding mechanism from a wire magazine into a guide head supported by a feeding beam of the drilling equipment and therethrough into a hole drilled in the rock.

In mechamized rock bolting, it is known to use a continuous string cord i.e. a wire cable as a bolt for the drill holes. The holes are drilled in the rock by means of an extension rod drilling equipment, whereafter the wire is inserted into the hole, which is filled with concrete either in advance or simultaneously.

U.S. Pat. Nos. 4,085,492 and 4,079,592 and Finnish patent applications 831,481and 822,622 disclose rock bolting devices in which the wire is pushed into the drill hole machinally by means of special wire feeding means. Such feeding means comprise a guide head or a rigid guide pipe through which the wire is fed into the drill hole and a feeding mechanism by means of which the wire is passed from a wire magazine to the guide head. As the bolting device is connected to the drilling equipment, by means of which the hole to be bolted is drilled, as disclosed in e.g. Finnish patent application 831,481, the wire feeding means are supported on the feeding beam of the drilling equipment in such a manner that the guide head can be turned to the drilling axis for carrying out the bolting and to the side of the drilling axis while the hole is being drilled.

It is characteristic of the known solutions that the wire feeding means are supported on the feeding beam of the drilling equipment or mounted on a separate feeding carriage, because the wire feeding mechanism has been tried to be positioned as close as possible to the guide head or the guide pipe which are to be displaced adjacent the drill hole. This has ensured that the wire has been fed smoothly into the hole as the wire is passed from the feeding mechanism directly into the guide head or the rigid guide pipe. On the contrary, it has been possible to position the wire magazine at a grreater distance from the feeding mechanism, e.g. on the carrier of the bolting device, whereby a freely hanging wire has been drawn from the carrier to the feeding beam by the feeding mechanism.

These known solutions, however, have certain major disadvantages. As the wire feeding mechanism is positioned beside the guide head or the guide pipe, it is liable to dirt and mechanical damage. The feeding mechanism increases considerably the weight of the feeding beam. In addition, the feeding mechanism takes plenty of room at the end of the feeding beam and hampers the movements of the feeding beam at narrow drilling sites.

The object of the present invention is to provide a method which avoids the above-mentioned disadvantages and enables the wire feeding mechanism to be positioned more appropriately without impairing the feeding of the wire into the drill hole. This object is achieved by means of a method according to the invention, which is characterized in that the wire is pushed into the guide head through a flexible guide pipe.

The invention is based on the idea that in place of the known solutions, wherein the wire is drawn to the inlet of the guide head or the guide pipe by the feeding mechanism, the wire is now pushed to the inlet of the guide head or pipe by the feeding mechanism. As the flexible guide pipe presents the wire from buckling, the pushing point of the wire, i.e. the feeding mechanism, can be positioned even at a fairly long distance from the guide head. By virtue of the invention, the feeding mechanism can be positioned at a desired place. The feeding mechanism can be mounted on the carrier of the bolting device to be protected against mechanical strains and dirt. The length of the wire between the feeding mechanism and the guide head is maintained constant all the time, irrespective of the positions of the drilling boom or the feeding beam. On account thereof, a measuring equipment indicating the feed length of the wire can be positioned on the carrier of the drilling equipment to be protected against mechanical strains and dirt.

The invention is also concerned with a device for guiding a wire in a wire bolting equipment, comprising a feeding beam with a drilling equipment thereof, said feeding beam being supported on a carrier, a guide head supported by the feeding beam for guiding the wire into the drill hole, a wire magazine, and a feeding mechanism for passing the wire into the guide head from the wire magazine.

The device is characterized by a flexible guide pipe provided for the wire between the feeding mechanism and the guide head.

The invention will be described in more detail below with reference to the attached drawing, which is a schematical side view of a rock bolting device whereto the present invention has been applied.

The bolting device mainly comprises a carrier 1 which supports a drilling equipment 3 by means of a boom system 2. The drilling equipment mainly comprises a feeding beam 4 hinged to the boom system, a drilling machine 5 and a drill rod cassette not shown. The bolting device further comprises feeding means (not shown) for a soldering agent. In these parts, the bolting device can be of the known structure disclosed in e.g. Finnish patent application 831,481.

The bolting device further comprises wire feeding means which mainly comprise a wire magazine 6 supported by the carrier, a feeding mechanism 7 and a rigid tubular guide head 8 supported on the feeding beam. The guide head is in a manner known per se turnable to the drilling axis A for guiding the wire through a guide 9 provded at the end of the feeding beam into a hole 10 drilled in the rock.

According to the invention the feeding mechansim 7 is mounted on the carrier 1 and connected to the rigid guide head by means of a flexible guide pipe 11 through which the wire 12 is passed from the feeding mechansim to the guide head. The guide pipe is at the ends 11*a*, 11*b* thereof fastened on the feeding mechanism and the guide head so that the length thereof is constant. The wire feeding mechanism can be of any known structure, e.g. formed by positively driven rolls, as disclosed in Finnish patent application 831,481, wherefore its structure will not be described more closely here.

For the installation of a bolt into the drill hole, the feeding mechanism 7 is started so that is pushes a wire drawn from the magazine 6 through the flexible guide pipe 11 into the guide head 8 and further into the drill hole. The flexible guide pipe supports the wire so that it is forced onwards in the guide pipe as it is pushed by the feeding mechanism, irrespective of the path of the guide pipe at any particular moment.

It is noted that the flexible guide pipe enables the feeding mechanism to be positioned at a sheltered place on the carrier, whereby the feeding beam becomes lighter and, additionally, less room is required at the end of the feeding beam. By virtue of the flexible guide pipe, the feeding beam can be turned to a desired drilling angle in each particular case and to a bolting angle with respect to the boom system 2. The flexible guide pipe also makes it possible to maintain the length of the wire at a constant value, regardless of the positions of the boom system and the feeding beam. On account thereof, the measuring equipment indicating the feed length of the wire can be mounted on the carrier.

The drawings and the description related thereto are only intended to illustrate the idea of the invention. In their details, the method and the device according to the invention may vary within the scope if the claims. The word "guide head" used in the claims is intended to also include guide pipes and other rigid guiding means and guides. The wire feeding mechanism can also be mounted at a distance from the forward end of the carrier and connected by means of a rigid guide pipe to a guide pipe fastened to the forward end of the carrier. The guide pipe can be of some other kind than a closed pipe, and the word "pipe" means in this connection also different kinds of open structures which form a tubular channel for the wire. The guide pipe must be essentially inextensible, of a determined length and flexible, and it must prevent the wire from buckling when it is pushed through the pipe. This pipe can be of a reticulate structure or spirally wired, or it can be formed of successive rings connected to each other.

What is claimed is:

1. A method of guiding a wire for rock bolting of a rock comprising the steps of:

feeding said wire from a wire magazine on a carrier through a single feeding mechanism;

passing said wire from said feeding mechanism through a flexible, nonpowered guide pipe;

moving said wire from said guide pipe into a guide head, said guide head being supported on a feeding beam mounted on said carrier; and inserting said wire from said guide head into a hole in said rock;

said feeding, passing, moving and inserting being powered solely by said feeding mechanim.

2. The method as recited in claim 1 and further comprising the steps of:

selectively pivoting said feeding beam relative to said carrier; and flexing said guide pipe in response to said selective pivoting of said feeding beam.

3. Wire bolting equipment comprising:

a carrier;

a wire magazine mounted on said carrier;

a feeding mechansim mounted on said carrier for withdrawing wire from said wire magazine;

a feeding beam having drilling equipment mounted thereon, said feeding beam being pivotably on said carrier;

a guide head supported on said feeding beam, said guide head guiding said wire into a drill hole in rock; and a flexible guide pipe extending between said guide head and said feeding mechanism, said pipe guiding said wire from said feeding mechanism to said guide head and said pipe being capable of flexing in response to pivoting of said feeding beam relative to said carrier.

4. The method according to claim 1, and further including the step of supporting the feeding mechanism from and the feeding beam by said carrier beam.

5. The method according to claim 4, wherein the wire is guided by means of the flexible guide pipe between the carrier and the guide head.

6. The equipment according to claim 2, wherein the guide pipe is at one end thereof connected to the guide head.

7. The equipment according to claim 6, wherein the guide pipe is at the other end thereof connected to the feeding mechanism.

8. The equipment according to claim 2, wherein the guide pipe is at one end thereof connected to a rigid guide pipe fastened to the feeding mechanism.

9. A device according to claim 6, wherein the feeding mechanism is mounted on a carrier.

* * * * *